US007291049B1

(12) United States Patent
Davis et al.

(10) Patent No.: US 7,291,049 B1
(45) Date of Patent: Nov. 6, 2007

(54) DRY SWIM TRAINER SYSTEM

(76) Inventors: James H. Davis, 914 Wynnewood Rd., Apt 1-B, Pelham, NY (US) 10803; Paul Dowd, 38 Milburn St., Bronxville, NY (US) 20708

( * ) Notice: Subject to any disclaimer, the term of this patent is extended or adjusted under 35 U.S.C. 154(b) by 0 days.

(21) Appl. No.: 11/605,638

(22) Filed: Nov. 29, 2006

(51) Int. Cl.
*A63B 69/10* (2006.01)

(52) U.S. Cl. ..... 441/55; 434/254; 482/55; 482/56

(58) Field of Classification Search ..... 441/55, 441/56, 57, 58, 59, 65, 129; 434/254, 255; 482/51, 55, 56
See application file for complete search history.

(56) References Cited

U.S. PATENT DOCUMENTS 3,074,716 A * 1/1963 Mitchel et al. ..... 482/56
4,674,740 A * 6/1987 Iams et al. ..... 482/56
4,830,363 A * 5/1989 Kennedy ..... 482/56
5,158,513 A 10/1992 Reeves
5,540,591 A * 7/1996 Doane ..... 434/254
6,142,912 A * 11/2000 Profaci ..... 482/56
6,352,493 B1 3/2002 Davis
6,764,431 B2 * 7/2004 Yoss ..... 482/56
6,790,164 B1 9/2004 Davis
7,044,818 B2 * 5/2006 Askins ..... 441/55

* cited by examiner

*Primary Examiner*—Lars A. Olson
(74) *Attorney, Agent, or Firm*—Edward P. Dutkiewicz

(57) ABSTRACT

A forward and rearward support assembly each have a vertical fixed post with upper and intermediate apertures and a pair of vertical reciprocable posts with upper and lower and intermediate apertures. Each support assembly has an upper and a lower oscillating plate. Each plate has an upper aperture. An upper pivot pin extends there through and through the apertures of the fixed posts. Each plate has a pair of laterally aligned lower apertures. Each plate has lower pivot pins. The lower pivot pins extend there through and through intermediate and lower apertures of the reciprocable posts. A forward and a rearward cradle and pivot pins couple the cradles and upper apertures of the reciprocable posts.

4 Claims, 4 Drawing Sheets

DRY SWIM TRAINER SYSTEM

BACKGROUND OF THE INVENTION

1. Field of the Invention

The present invention relates to a dry swim trainer system and more particularly pertains to allowing swimmers to train and practice their strokes out of water.

2. Description of the Prior Art

The use of swimming trainer systems of known designs and configurations is known in the prior art. More specifically, swimming trainer systems of known designs and configurations previously devised and utilized for the purpose of simulating swimming out of water through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,158,513 issued Oct. 27, 1992 to Reeves relates to a Swimming Exercise and Training Apparatus. U.S. Pat. No. 6,352,493 issued Mar. 5, 2002 to Davis relates to a Swimming Simulation System and U.S. Pat. No. 6,790,164 issued Sep. 14, 2004 to Davis relates to a Swimming Simulation System.

While these devices fulfill their respective, particular objectives and requirements, the aforementioned patents do not describe a dry swim trainer system that allows swimmers to train and practice their strokes out of water.

In this respect, the dry swim trainer system according to the present invention substantially departs from the conventional concepts and designs of the prior art, and in doing so provides an apparatus primarily developed for the purpose of allowing swimmers to train and practice their strokes out of water.

Therefore, it can be appreciated that there exists a continuing need for a new and improved dry swim trainer system which can be used for allowing swimmers to train and practice their strokes out of water. In this regard, the present invention substantially fulfills this need.

SUMMARY OF THE INVENTION

In view of the foregoing disadvantages inherent in the known types of swimming trainer systems of known designs and configurations now present in the prior art, the present invention provides an improved dry swim trainer system. As such, the general purpose of the present invention, which will be described subsequently in greater detail, is to provide a new and improved dry swim trainer system and method which has all the advantages of the prior art and none of the disadvantages.

To attain this, the present invention essentially comprises a dry swim trainer system. First provided is a forward support assembly. A similarly configured rearward support assembly is provided. Each support assembly has a vertical fixed post. The vertical fixed post has an upper end. The upper end of the vertical fixed post has an upper horizontal aperture. The vertical fixed post has a lower end. An intermediate extent is provided between the upper end and the lower end. The intermediate extent has an intermediate horizontal aperture. The lower end has laterally extending braces. The laterally extending braces are positionable on a horizontal recipient surface.

Each support assembly has a pair of vertical reciprocable posts. Each vertical reciprocable post has an upper end. The upper end of each vertical reciprocable post has an upper horizontal aperture. Each vertical reciprocable post has a lower end. The lower end of each vertical reciprocable post has a lower horizontal aperture. An intermediate extent is provided between the upper end and the lower end. The intermediate extent has an intermediate horizontal aperture.

Each support assembly has an upper oscillating plate and a lower oscillating plate. Each oscillating plate has a row of vertically aligned horizontal upper apertures. Each oscillating plate has a threaded pivot pin. The threaded pivot pins extend through the horizontal apertures of the fixed posts and a preselected aperture of the oscillating plates. Each oscillating plate has a pair of laterally aligned horizontal lower apertures. Each oscillating plate has pairs of threaded pivot pin. The pairs of threaded pivot pins include upper pivot pins. The upper pivot pins extend through the lower apertures of the upper pivot plate and the intermediate apertures of the reciprocable posts. The pairs of threaded pivot pins include lower pivot pins. The lower pivot pins extend through the lower apertures of the lower pivot plate and the lower apertures of the reciprocable posts. Each pivot pin has threaded ends. The threaded ends have nuts with intermediate washers. The nuts for the pivot pins of the fixed posts are adapted to increase and decrease the tension required for operation and use.

Further provided is a forward cradle. The forward cradle is adapted to receive and support the torso of a user during operation and use. A rearward cradle is provided. The rearward cradle is adapted to receive and support the legs of a user during operation and use. Each cradle has depending projections. Each cradle has a brace. Horizontal apertures and threaded pivot pins are provided. The threaded pivot pins couple the projections and braces and upper apertures of the reciprocable posts. Each pivot pin has threaded ends. The threaded ends have nuts with intermediate washers. In this manner a user supported by the cradles and simulating a swimming stroke will rotate about an axis of rotation. The training and practicing strokes out of water is thus facilitated.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings.

The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dry swim trainer system which has all of the advantages of the prior art swimming trainer systems of known designs and configurations and none of the disadvantages.

It is another object of the present invention to provide a new and improved dry swim trainer system which may be easily and efficiently manufactured and marketed.

It is further object of the present invention to provide a new and improved dry swim trainer system which is of durable and reliable constructions.

An even further object of the present invention is to provide a new and improved dry swim trainer system which is susceptible of a low cost of manufacture with regard to both materials and labor, and which accordingly is then susceptible of low prices of sale to the consuming public, thereby making such dry swim trainer system economically available to the buying public.

Even still another object of the present invention is to provide a dry swim trainer system for allowing swimmers to train and practice their strokes out of water.

Lastly, it is an object of the present invention to provide a new and improved dry swim trainer system. A forward and rearward support assembly each have a vertical fixed post with upper and intermediate apertures and a pair of vertical reciprocable posts with upper and lower and intermediate apertures. Each support assembly has an upper and a lower oscillating plate. Each plate has an upper aperture with an upper pivot pin extending there through and through the apertures of the fixed posts. Each plate has a pair of laterally aligned lower apertures with lower pivot pins extending there through and through the intermediate and lower apertures of the reciprocable posts. A forward and a rearward cradle and pivot pins couple the cradles and upper apertures of the reciprocable posts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
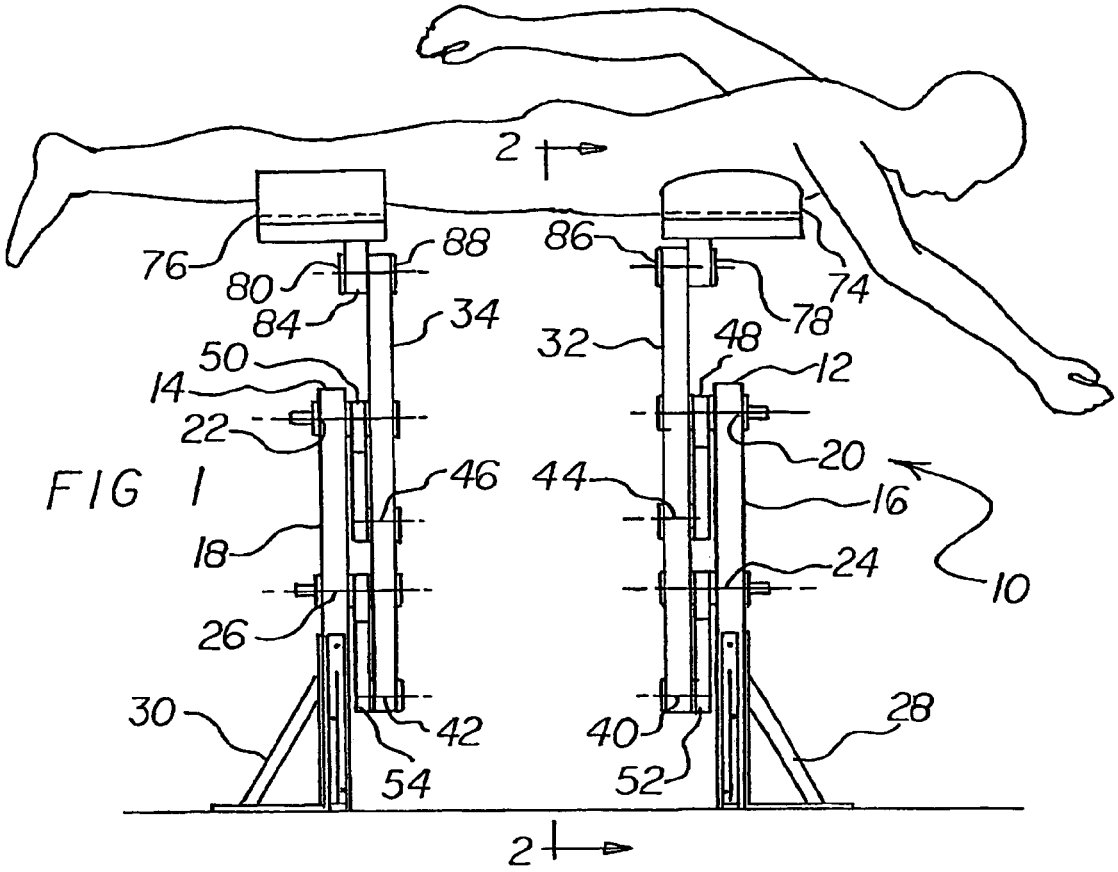
FIG. 1 is a side elevational view of a dry swim trainer system constructed in accordance with the principles of the present invention.
Figure 2:
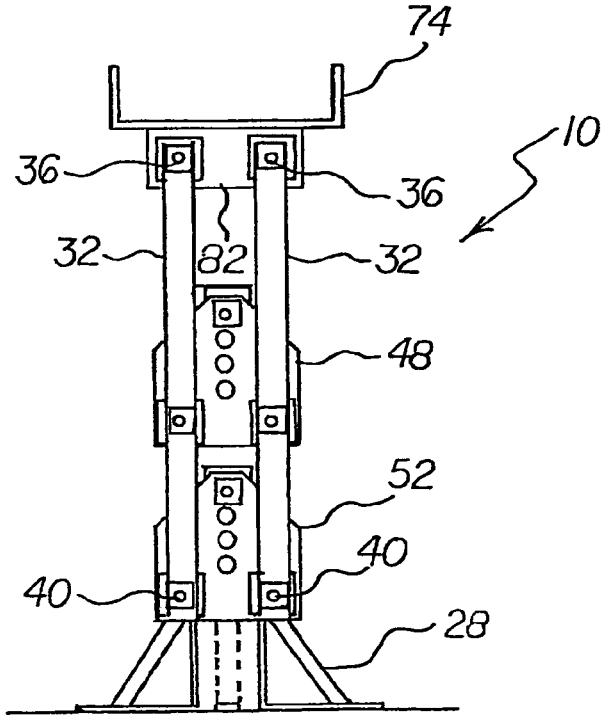
FIG. 2 is a rear elevational view of the front assembly taken along line 2-2 of FIG. 1.
Figure 3:
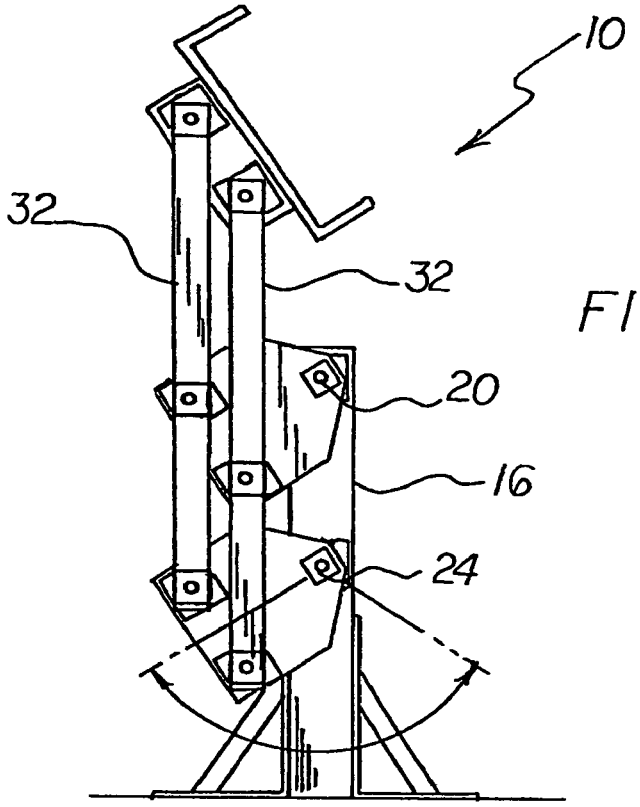
FIG. 3 is a rear elevational view similar to FIG. 2 but with the support tray in a first angular orientation.
Figure 4:
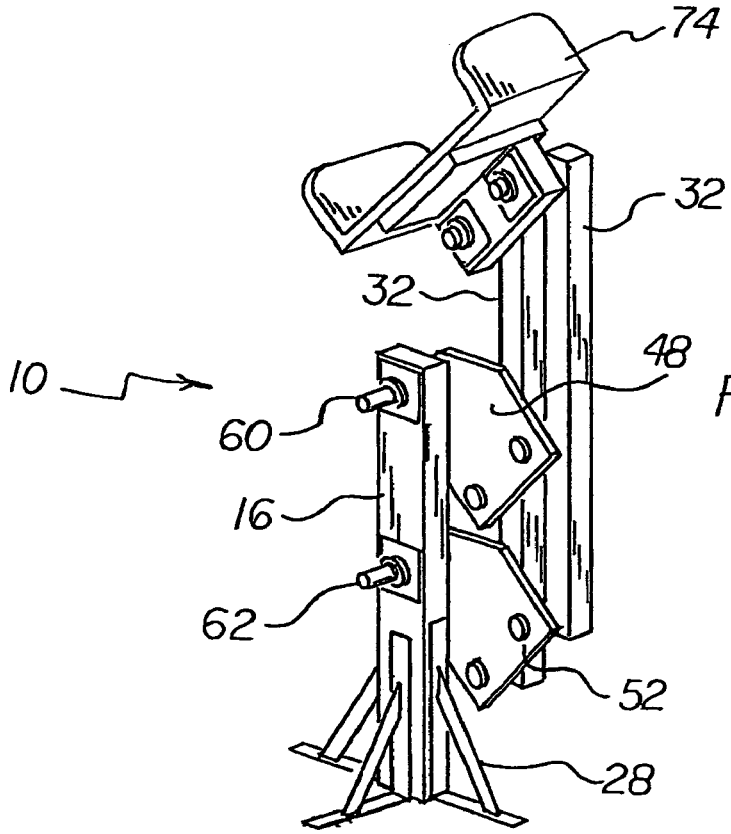
FIG. 4 is a front perspective view similar to FIG. 3 but with the support tray in a second angular orientation.
Figure 5:
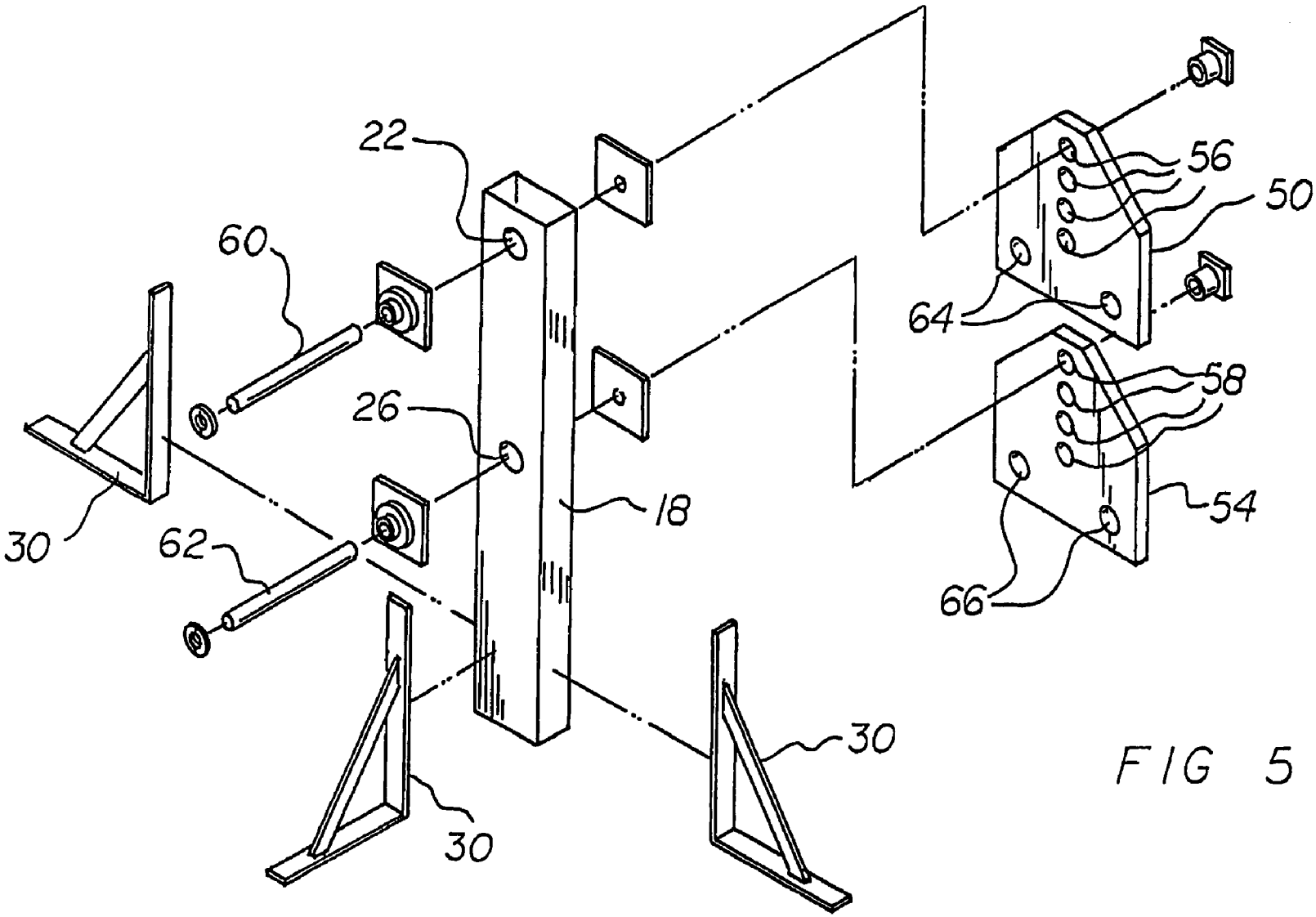
FIG. 5 is an exploded perspective illustration of the fixed portion of the front assembly illustrated in FIGS. 2 through 4.
Figure 6:
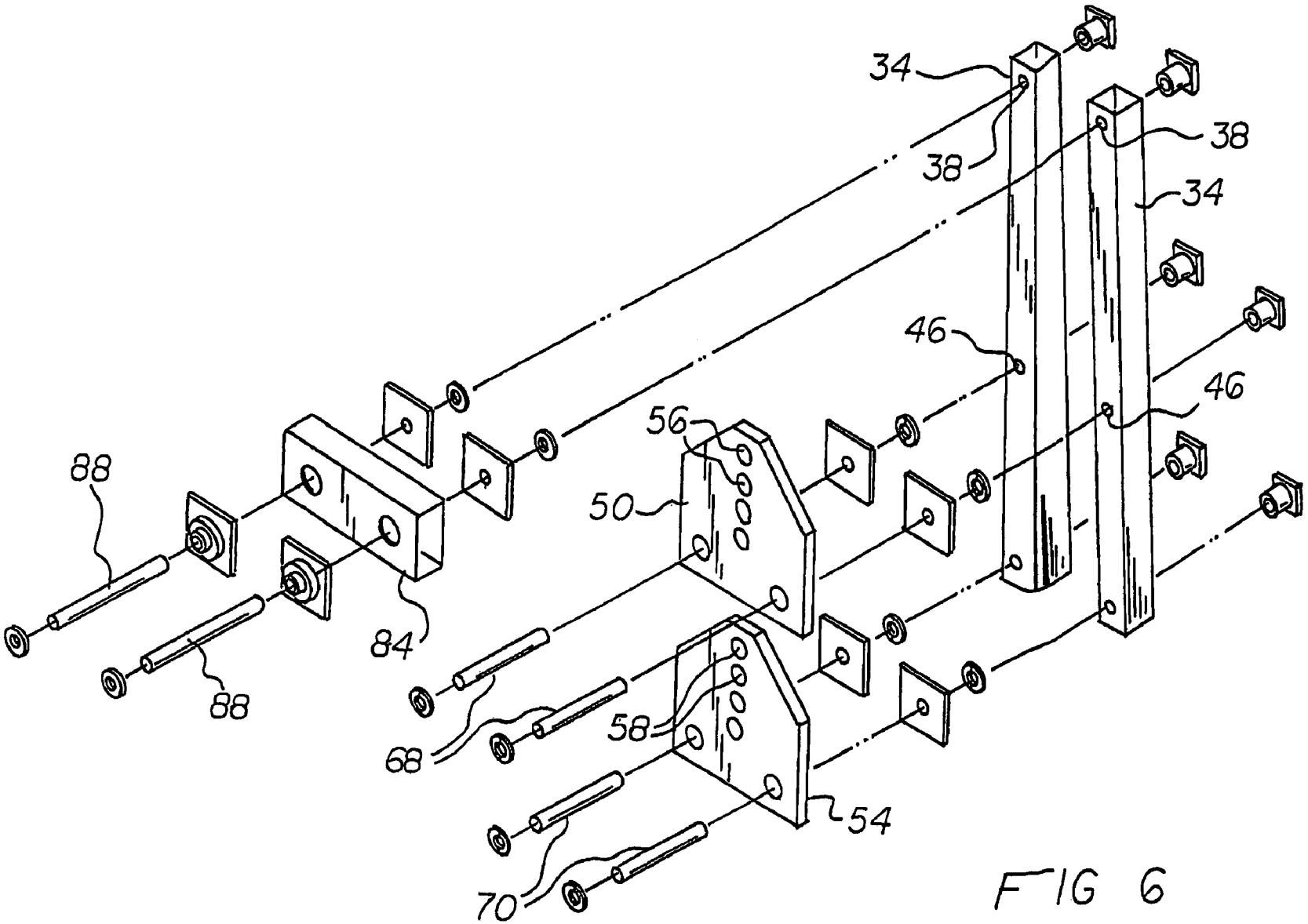
FIG. 6 is an exploded perspective illustration of the movable portion of the front assembly illustrated in FIGS. 2 through 4.

With reference now to the drawings, and in particular to FIG. 1 thereof, the preferred embodiment of the new and improved dry swim trainer system embodying the principles and concepts of the present invention and generally designated by the reference numeral 10 will be described.

The present invention, the dry swim trainer system 10 is comprised of a plurality of components. Such components in their broadest context include a forward and rearward support assembly and a forward and rearward cradle. Such components are individually configured and correlated with respect to each other so as to attain the desired objective.

First provided is a forward support assembly 12. A similarly configured rearward support assembly 14 is provided. Each support assembly has a vertical fixed post 16, 18. Each vertical fixed post has an upper end. The upper end of each vertical fixed post has an upper horizontal aperture 20, 22. Each vertical fixed post has a lower end. An intermediate extent is provided between each upper end and the lower end. Each intermediate extent has an intermediate horizontal aperture 24, 26. Each lower end has laterally extending braces 28, 30. The laterally extending braces are positionable on a horizontal recipient surface.

Each support assembly has a pair of vertical reciprocable posts 32, 34. Each vertical reciprocable post has an upper end. The upper end of each vertical reciprocable post has an upper horizontal aperture 36, 38. Each vertical reciprocable post has a lower end. The lower end of each vertical reciprocable post has a lower horizontal aperture 40, 42. An intermediate extent is provided between each upper end and lower end. Each intermediate extent has an intermediate horizontal aperture 44, 46.

Each support assembly has an upper oscillating plate 48, 50 and a lower oscillating plate 52, 54. Each oscillating plate has a row of vertically aligned horizontal upper apertures 56, 58. Each oscillating plate has a threaded pivot pin 60, 62. The threaded pivot pin extends through the horizontal apertures of the fixed posts and a preselected aperture of the oscillating plates. Each oscillating plate has a pair of laterally aligned horizontal lower apertures 64, 66. Each oscillating plate has pairs of threaded pivot pin 68, 70. The pairs of threaded pivot pins include upper pivot pins 68. The upper pivot pins extend through the lower apertures of the upper pivot plate and the intermediate apertures of the reciprocable posts. The pairs of threaded pivot pins include lower pivot pins 70. The lower pivot pins extend through the lower apertures of the lower pivot plate and the lower apertures of the reciprocable posts. Each pivot pin has threaded ends. The threaded ends have nuts 72 with intermediate washers. The nuts for the pivot pins of the fixed posts are adapted to increase and decrease the tension required for operation and use.

Further provided is a forward cradle 74. The forward cradle has a curved upper edge and is adapted to receive and support the torso of a user during operation and use. A rearward cradle 76 is provided. The rearward cradle has a square upper edge and is adapted to receive and support the legs of a user during operation and use. Each cradle has depending projections 78, 80. Each cradle has a brace 82, 84. Horizontal apertures and threaded pivot pins 86, 88 are provided. The threaded pivot pins couple the projections and braces and upper apertures of the reciprocable posts. Each pivot pin has threaded ends. The threaded ends have nuts with intermediate washers. In this manner a user supported by the cradles and simulating a swimming stroke will rotate about an axis of rotation extending through the body of the user. The training and practicing strokes out of water is thus facilitated.

The two support assemblies are illustrated in the preferred embodiment as being independently supported on a recipient surface, the floor. This allows such support assemblies to be moved closer together or farther apart to accommodate users of different sizes. It should be understood that other embodiments are adapted to be used, as for example, support assemblies on a common track for varying the spacing while ensuring correct alignment.

From the above descriptions, it may be appreciated that the present invention provides a system with two distinctive features not found in the prior art. The first feature is the structure which maintains a fixed center of rotation through the user during operation and use. The second feature is the structure which makes the user work body core muscles rather than merely arm muscles. These two distinctive features, particularly when used together, make for a training and practice device which is superior to anything previously known and which is a significant advance in the technology. The system of the present invention is particularly useful in training and practice for a swimmer's long axis strokes, free style and back stroke.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dry swim trainer system comprising:

a forward and rearward support assembly, each having a vertical fixed post with upper and intermediate apertures and a pair of vertical reciprocable posts with upper and lower and intermediate apertures;

each support assembly having an upper and a lower oscillating plate, each plate having an upper aperture with an upper pivot pin extending therethrough and through apertures of the fixed posts, each plate having a pair of laterally aligned lower apertures with lower pivot pins extending therethrough and through intermediate and lower apertures of the reciprocable posts; and a forward and a rearward cradle and pivot pins coupling the cradles and upper apertures of the reciprocable posts.

2. The system as set forth in claim 1 and further including nuts for the pivot pins of the fixed posts adapted to increase and decrease the tension required for operation and use.

3. The system as set forth in claim 1 and further including for each cradle, a depending projections and a brace with horizontal apertures and pivot pins coupling the projections and braces and upper apertures of the reciprocable posts.

4. A dry swim trainer system for allowing swimmers to train and practice their strokes out of water comprising, in combination:

a forward support assembly and a similarly configured rearward support assembly, each support assembly having a vertical fixed post with an upper end having an upper horizontal aperture and a lower end and an intermediate extent there between with an intermediate horizontal aperture, the lower end having laterally extending braces positionable on a horizontal recipient surface;

each support assembly having a pair of vertical reciprocable posts each with an upper end having an upper horizontal aperture and a lower end having a lower horizontal aperture and an intermediate extent therebetween having an intermediate horizontal aperture;

each support assembly having an upper oscillating plate and a lower oscillating plate, each oscillating plate having a row of vertically aligned horizontal upper apertures with a threaded pivot pin extending through the horizontal apertures of the fixed posts and a preselected aperture of the oscillating plates, each oscillating plate having a pair of laterally aligned horizontal lower apertures with pairs of threaded pivot pins, the pairs of threaded pivot pins including upper pivot pins extending through the lower apertures of the upper pivot plate and the intermediate apertures of the reciprocable posts, the pairs of threaded pivot pins including lower pivot pins extending through the lower apertures of the lower pivot plate and the lower apertures of the reciprocable posts, each pivot pin having threaded ends with nuts with intermediate washers, the nuts for the pivot pins of the fixed posts adapted to increase and decrease the tension required for operation and use; and a forward cradle adapted to receive and support the torso of a user during operation and use and a rearward cradle adapted to receive and support the legs of a user during operation and use, each cradle having depending projections with a brace with horizontal apertures and threaded pivot pins coupling the projections and braces and upper apertures of the reciprocable posts, each pivot pin having threaded ends with nuts with intermediate washers whereby a user supported by the cradles and simulating a swimming stroke will rotate about an axis of rotation to facilitate the training and practicing strokes out of water.

* * * * *